US005890362A

United States Patent [19]

Wilke

[11] Patent Number: 5,890,362

[45] Date of Patent: Apr. 6, 1999

[54] HYDRAULIC CONTROL VALVE SYSTEM WITH NON-SHUTTLE PRESSURE COMPENSATOR

[75] Inventor: Raud A. Wilke, Dousman, Wis.

[73] Assignee: Husco International, Inc., Waukesha, Wis.

[21] Appl. No.: 956,353

[22] Filed: Oct. 23, 1997

[51] Int. Cl.[6] ..... F15B 13/08

[52] U.S. Cl. ..... 60/427; 60/452; 91/446; 91/518; 137/596.13

[58] Field of Search ..... 60/427, 452; 91/446, 91/518; 137/596.13

[56] References Cited

U.S. PATENT DOCUMENTS

| | | | |
|---|---|---|---|
| 3,881,512 | 5/1975 | Wilke | 137/596.13 |
| 4,446,890 | 5/1984 | Simpson, Jr. | 137/87 |
| 4,548,239 | 10/1985 | Eskildsen | 137/625.68 |
| 4,679,765 | 7/1987 | Kramer et al. | 251/38 |
| 4,693,272 | 9/1987 | Wilke | 137/596 |
| 4,736,770 | 4/1988 | Rousset et al. | 137/596 |
| 5,025,625 | 6/1991 | Morikawa | 60/426 |
| 5,036,750 | 8/1991 | Katayama | 91/464 |
| 5,038,671 | 8/1991 | Ueno | 91/517 |
| 5,067,389 | 11/1991 | St. Germain | 60/427 X |
| 5,076,143 | 12/1991 | Ogawa | 91/420 |
| 5,113,894 | 5/1992 | Yoshida | 137/106 |
| 5,138,837 | 8/1992 | Obertrifter et al. | 60/426 |
| 5,161,373 | 11/1992 | Morikawa et al. | 60/484 |
| 5,222,426 | 6/1993 | Marcon et al. | 91/446 |
| 5,305,789 | 4/1994 | Rivolier | 137/596 |
| 5,315,826 | 5/1994 | Hirata et al. | 60/422 |
| 5,347,811 | 9/1994 | Hasegawa et al. | 60/426 |
| 5,400,816 | 3/1995 | Gerstenberger | 137/106 |
| 5,579,642 | 12/1996 | Wilke et al. | 60/426 |
| 5,579,676 | 12/1996 | Wilke | 91/420 |
| 5,592,967 | 1/1997 | Cho | 91/447 X |

*Primary Examiner*—Gerald A. Michalsky
*Attorney, Agent, or Firm*—Quarles & Brady

[57] ABSTRACT

An improved pressure-compensated hydraulic system for feeding hydraulic fluid from a variable displacement pump to multiple hydraulic actuators. A separate valve section controls the fluid flow between the pump and a different actuator. Each valve section has a pressure compensating valve with a valve member and poppet within a bore and biased apart by a spring. The poppet acts as a check valve which prevents fluid flow from the actuator through the valve section to the pump when the back pressure from the load exceeds the pump supply pressure. A pressure differential between the load-dependent pressure and the actuator pressure determines a position of the valve member which controls the pressure applied to the pump pressure control input.

14 Claims, 4 Drawing Sheets

HYDRAULIC CONTROL VALVE SYSTEM WITH NON-SHUTTLE PRESSURE COMPENSATOR

FIELD OF THE INVENTION

The present invention relates to valve assemblies which control hydraulically powered machinery; and more particularly to pressure compensated valves wherein a fixed differential pressure is to be maintained to achieve a uniform flow rate.

BACKGROUND OF THE INVENTION

The speed of a hydraulically driven working member on a machine depends upon the cross-sectional area of principal narrowed orifices of the hydraulic system and the pressure drop across those orifices. To facilitate control, pressure compensating hydraulic control systems have been designed to set and maintain the pressure drop. These previous control systems include sense lines which transmit the pressure at the valve workports to the input of a variable displacement hydraulic pump which supplies pressurized hydraulic fluid in the system. The resulting self-adjustment of the pump output provides an approximately constant pressure drop across a control orifice whose cross-sectional area can be controlled by the machine operator. This facilitates control because, with the pressure drop held constant, the speed of movement of the working member is determined only by the cross-sectional area of the orifice. One such system is disclosed in U.S. Pat. No. 4,693,272 entitled "Post Pressure Compensated Unitary Hydraulic Valve", the disclosure of which is incorporated herein by reference.

Because the control valves and hydraulic pump in such a system normally are not immediately adjacent to each other, the changing load pressure information must be transmitted to the remote pump input through hoses or other conduits which can be relatively long. Some hydraulic fluid tends to drain out of these conduits while the machine is in a stopped, neutral state. When the operator again calls for motion, these conduits must refill before the pressure compensation system can be fully effective. Due to the length of these conduits, the response of the pump may lag, and a slight dipping of the loads can occur, which characteristics may be referred to as the "lag time" and "start-up dipping" problems.

In some types of hydraulic systems, the "bottoming out" of a piston drive a load could cause the entire system to "hang up". This could occur in such systems which used the greatest of the workport pressures to motivate the pressure compensation system. In that case, the bottomed out load has the greatest workport pressure and the pump is unable to provide a greater pressure; thus there would no longer be a pressure drop across the control orifice. As a remedy, such systems may include a pressure relief valve in a load sensing circuit of the hydraulic control system. In the bottomed out situation, the relief valve opens to drop the sensed pressure to the load sense relief pressure, enabling the pump to provide a pressure drop across the control orifice.

While this solution is effective, it may have an undesirable side effect in systems which use a pressure compensating check valve as part of the means of holding substantially constant the pressure drop across the control orifice. The pressure relief valve could open even when no piston was bottomed out if a workport pressure exceeded the set-point of the load sense relief valve. In that case, some fluid could flow from the workport backwards through the pressure compensating check valve into the pump chamber. As a result, the load could dip, which condition may be referred to as a "backflow" problem.

Another drawback of previous pressure compensating hydraulic control systems is the large number of components. For example the system described in U.S. Pat. No. 5,579,642 provides a chain of shuttle valves which sense the pressure at every powered workport of each valve section. The output pressure of that chain is applied to an isolator valve which connects the control input of the pump to either the pump output or to the tank depending upon the sensed workport pressure. It is desirable to simplify the structure of the pressure compensating hydraulic control system and reduce manufacturing complexity.

SUMMARY OF THE INVENTION

The present invention is directed toward satisfying those needs.

A hydraulic valve assembly for feeding hydraulic fluid to multiple actuators includes a pump of the type that produces a variable output pressure which at any time is the sum of input pressure at a pump control input and a constant margin pressure. A separate valve section controlling the flow of hydraulic fluid from the pump to a different actuator is subjected to a load force exerted on that actuator which creates a hydraulic load pressure. The valve sections are of a type in which the greatest hydraulic load pressure is senses and used to control a load sense pressure which is transmitted to the pump control input.

Each valve section has a variable metering orifice through which the hydraulic fluid passes from the pump to the associated actuator. Thus, the pump output pressure is applied to one side of the metering orifice. A pressure compensating valve within each valve section provides the load sense pressure at the other side of the metering orifice, so that the pressure drop across the metering orifice is substantially equal to the constant pressure margin. The pressure compensator has a spool and a valve member that slide within a bore and are biased apart by a spring. The spool and valve member define first and second chambers at opposite ends of the bore and an intermediate chamber there between. The first chamber communicates with the other side of the metering orifice and the second chamber is in communication with the pump control input. The bore has a output port from which fluid is supplied to the associated hydraulic actuator and the intermediate chamber communicates with the output port to receive the hydraulic load pressure. An inlet port of the bore receives the output pressure from the pump.

A first pressure differential between the first and intermediate chambers and a force exerted by the spring determine a position of the poppet within the bore. The position of the poppet defines a size of a passage through the bore between the first chamber and the output port and thus the flow of hydraulic fluid to the actuator. Specifically a greater pressure in the first chamber than in the intermediate chamber enlarges the size of the output port, whereas a greater pressure in the intermediate chamber than in the first chamber reduces the output port size. Thus the poppet acts as a check valve which prevents fluid flow from the actuator through the valve section to the pump when the back pressure from the load exceeds the pump supply pressure.

A second pressure differential between the second and intermediate chambers and a force exerted by the spring determine a position of the valve member within the bore. That position controls communication between the bore inlet port and the pump control input and thus transmission of the pump output pressure to the pump control input. Specifically, a greater pressure in the second chamber than in the intermediate chamber urges the valve member to reduce communication between bore inlet port and the pump control input, and a greater pressure in the intermediate chamber than in the first chamber urges the valve member to increase communication between the bore inlet port and the pump control input. As a result, the pressure applied to control the variable displacement hydraulic pump in obtained directly from the pressure compensating valves without requiring a separate chain of shuttle valves and an isolation valve as in previous valve assemblies.

DETAILED DESCRIPTION OF THE INVENTION

Figure 1:
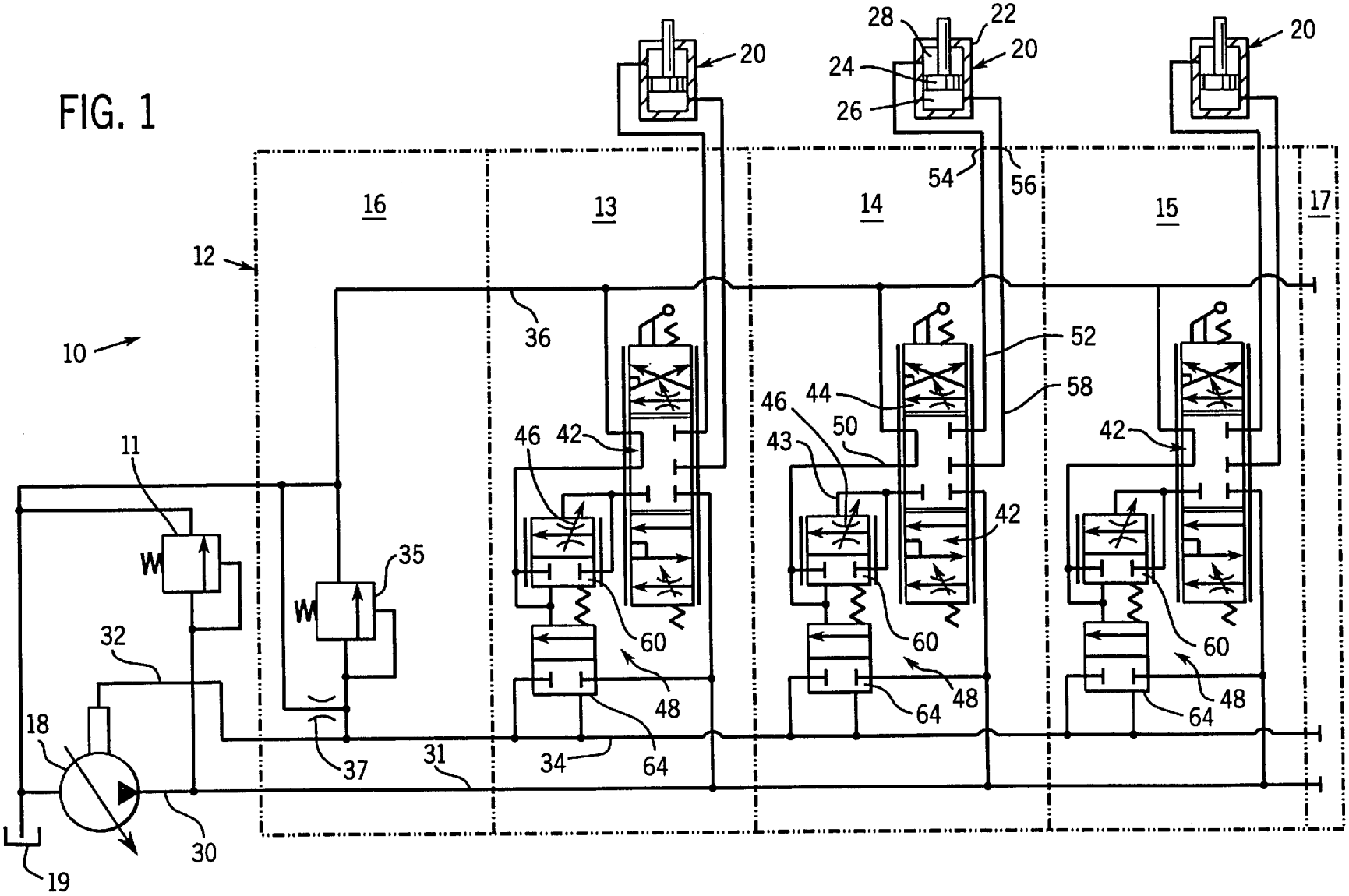
FIG. 1 a schematic diagram of a hydraulic system with a multiple valve assembly which incorporates a novel pressure compensator according to the present invention.

FIG. 1 schematically depicts a hydraulic system 10 having a multiple valve assembly 12 which controls motion of hydraulically powered working members of a machine, such as the boom and bucket of a backhoe. The physical structure of the valve assembly 12 comprises several individual valve sections 13, 14 and 15 interconnected side-by-side between two end sections 16 and 17. A given valve section 13, 14 or 15 controls the flow of hydraulic fluid from a pump 18 to one of several actuators 20 connected to the working members and controls the return of the fluid to a reservoir or tank 19. The output of pump 18 is protected by a pressure relief valve 11. Each actuator 20 has a cylinder housing 22 containing a piston 24 that divides the housing interior into a bottom chamber 26 and a top chamber 28. References herein to directional relationships and movement, such as top and bottom or up and down, refer to the relationship and movement of the components in the orientation illustrated in the drawings, which may not be the orientation of the components as attached to a working member on the machine.

The pump 18 typically is located remotely from the valve assembly 12 and is connected by a supply conduit or hose 30 to a supply passage 31 extending through the valve assembly 12. The pump 18 is a variable displacement type whose output pressure is designed to be the sum of the pressure at a displacement control port 32 plus a constant pressure, known as the "margin." The control port 32 is connected to a transfer passage 34 that extends through the sections 13–15 of the valve assembly 12. A reservoir passage 36 also extends through the valve assembly 12 and is coupled to the tank 19. End section 16 of the valve assembly 12 contains ports for connecting the supply passage 31 to the pump 18, the reservoir passage 36 to the tank 19 and the transfer passage 34 to the control port 32 of pump 18. That end section 16 also includes a pressure relief valve 35 that relieves excessive pressure in the pump control transfer passage 34 to the tank 19. An orifice 37 provides a flow path between the transfer passage 34 and the tank 19, the function of which will be described subsequently.

To facilitate understanding of the invention claimed herein, it is useful to describe basic fluid flow paths with respect to one of the valve sections 14 in the illustrated embodiment. The other valve sections 13 and 15 operate in an identical manner to section 14, and the following description is applicable them as well.

Figure 2:
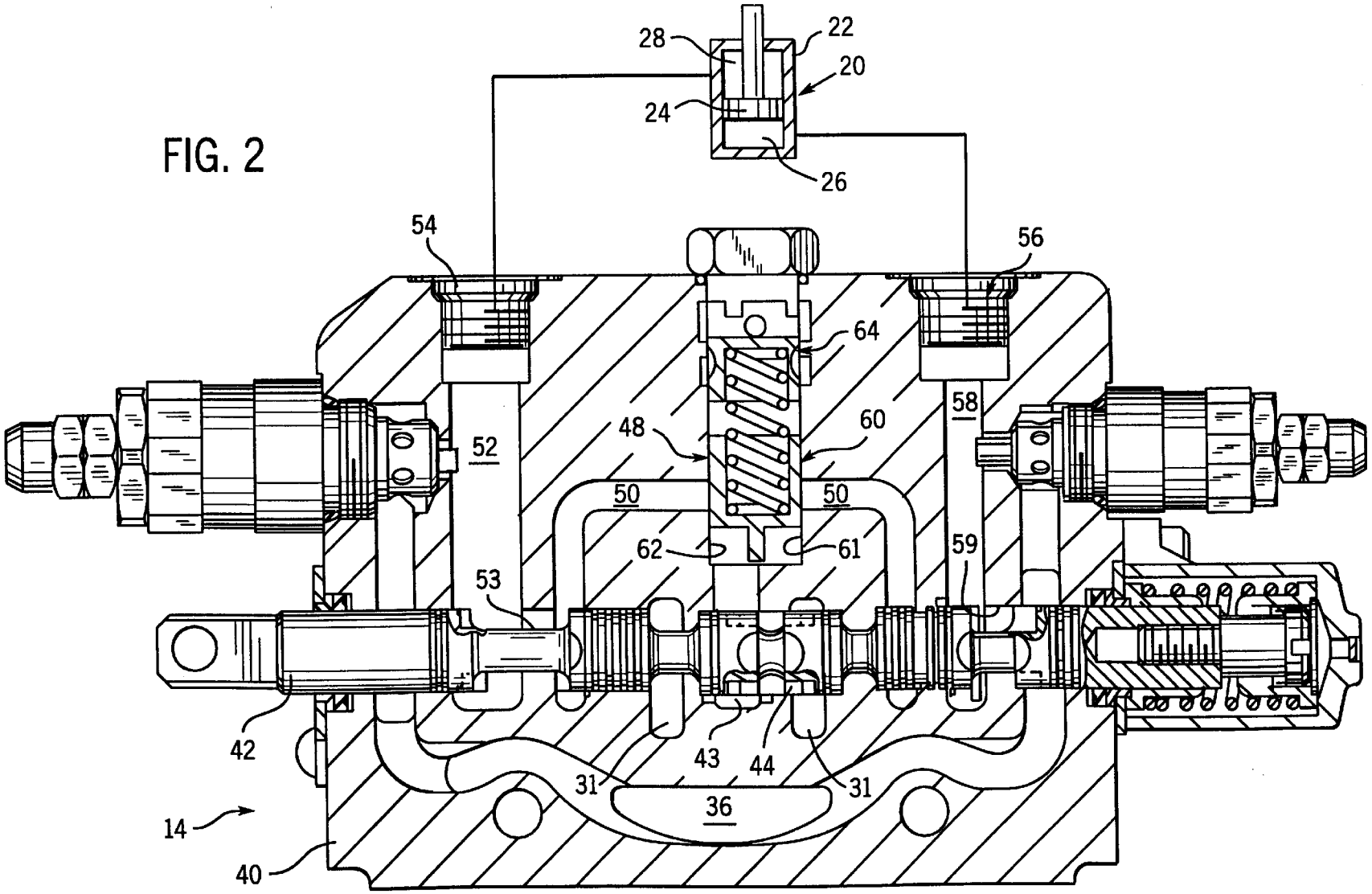
FIG. 2 is a cross-sectional view through one section of the multiple valve assembly in FIG. 1 and schematically shows connection to a hydraulic cylinder.

With additional reference to FIG. 2, valve section 14 has a body 40 and control spool 42 which a machine operator can move in reciprocal directions within a bore in the body by operating a control member (not shown) attached thereto. Depending on which direction that the control spool 42 is moved, hydraulic fluid is directed to the bottom or top chamber 26 or 28 of a cylinder housing 22 thereby driving the piston 24 up or down, respectively. The extent to which the machine operator moves control spool 42 determines the speed of the piston 24, and thus that of the working member connected to the piston.

To lower the piston 24, the machine operator moves the control spool 42 rightward into the position illustrated in FIG. 2. This opens passages which allow the pump 18 (under the control of the load sensing network to be described later) to draw hydraulic fluid from the tank 19 and force the fluid through pump output conduit 30, into a supply passage 31 in the body 40. From the supply passage 31 the hydraulic fluid passes through a metering orifice formed by a set of notches 44 of the control spool 42, through feeder passage 43 and a variable orifice 46 (see FIG. 1) formed by the relative position between a pressure compensating check valve 48 and an opening in the body 40 to the bridge passage 50. In the open state of pressure compensating check valve 48, the hydraulic fluid travels through a bridge passage 50, a channel 53 of the control spool 42 and then through workport passage 52, out of workport 54 and into the upper chamber 28 of the cylinder housing 22. The pressure thus transmitted to the top of the piston 24 causes it to move downward, which forces hydraulic fluid out of the bottom chamber 26 of the cylinder housing 22. This exiting hydraulic fluid flows into another valve assembly workport 56, through the workport passage 58, the control spool 42 via passage 59 and the reservoir passage 36 that is coupled to the tank 19.

To move the piston 24 upward, the machine operator moves control spool 42 to the left, which opens a corresponding set of passages so that the pump 18 forces hydraulic fluid into the bottom chamber 26, and push fluid out of the top chamber 28 of cylinder housing 22, causing piston 24 to move upward.

In the absence of a pressure compensation mechanism, the machine operator would have difficulty controlling the speed of the piston 24. This difficulty results from the speed of piston movement being directly related to the hydraulic fluid flow rate, which is determined primarily by two variables—the cross sectional areas of the most restrictive orifices in the flow path and the pressure drops across those orifices. One of the most restrictive orifices is the metering orifice 44 of the control spool 42 and the machine operator is able to control the cross sectional area of that metering orifice by moving the control spool. Although this controls one variable which helps determine the flow rate, it provides less than optimum control because the flow rate also is directly proportional to the square root of the total pressure drop in the system, which occurs primarily across metering orifice 44 of the control spool 42. For example, adding material into the bucket of a backhoe might increase pressure in the bottom cylinder chamber 26, which would reduce the difference between that load pressure and the pressure provided by the pump 18. Without pressure compensation, this reduction of the total pressure drop would reduce the flow rate and thereby reduce the speed of the piston 24 even if the machine operator holds the metering orifice 44 at a constant cross sectional area.

Figure 3:
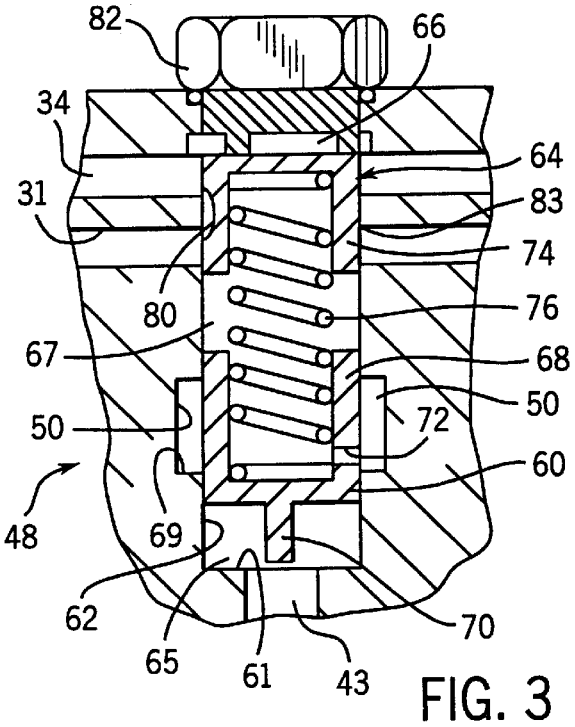
FIGS. 3–6 are cross-sectional views through a portion of a valve section showing a compensation valve in different operational states.

The present invention relates to a pressure compensation mechanism that is based upon a separate valve 48 in each valve section 13–15. With reference to FIGS. 1–3, the pressure compensating valve 48 has a poppet 60 and a valve element 64 both of which sealingly slide reciprocally in a bore 62 of the valve body 40. The poppet 60 and a valve element 64 divide the bore 62 into variable volume first and second chambers 65 and 66 at opposite ends of the bore and an intermediate chamber 67 therebetween, as seen in FIG. 3. The first chamber 65, adjacent bore end wall 61, is in communication with feeder passage 43, while the second chamber 66 communicates with the load sense transfer passage 34 connected to the pump control port 32.

The poppet 60 is unbiased with respect to the end of the bore 62 which defines the first chamber 65 and the valve element 64 is unbiased with respect to the end of the bore which defines the second chamber 66. As used herein, "unbiased" refers to the lack of a mechanical device, such as a spring, which would exert force on the poppet or valve element thereby urging that component away from the respective end of the bore. As will be described, the absence of such a biasing device results in only the pressure within the first chamber 65 urging the poppet 60 away from the adjacent end of the bore 62, and only the pressure within the second chamber 66 urging the valve element 64 away from the opposite bore end.

Figure 4:
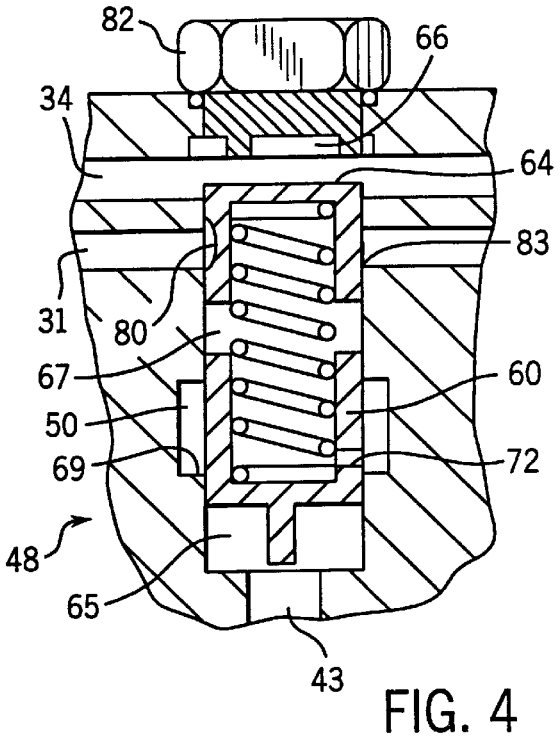

The poppet 60 has a tubular section 68 with an open end and a closed end from which extends a reduced diameter stop shaft 70 that strikes end wall 61 in the states shown in FIGS. 1, 3 and 4. The tubular section 68 has a transverse aperture 72 which, regardless of the position of poppet 60, provides continuous communication between the interior of the tubular section 68 (i.e. intermediated chamber 67) and the bridge passage 50, connected to the bore at an outlet port 69(see also FIGS. 5 and 6).

The valve element 64 has a tubular portion 74 with an open end that faces the open end of the poppet 60. A relatively weak spring 76 within the tubular portions 68 and 74 biases the poppet 60 and valve element 64 apart. The outer surface of the tubular portion 74 of the valve element 64 has a notch 80. When the valve element 64 abuts a threaded plug 82, which closes the bore 62, the notch 80 provides a fluid passage between the load sense transfer passage 34 and a bore inlet port 83 coupled to portion of the supply passage 31 from pump 18. When the valve element 64 moves appreciably away from the plug 82 that fluid passage is closed, see FIG. 4.

FIGS. 3–6 depict four operational states of the poppet 60 and valve element 64. The states in FIGS. 3 and 5 may exist when the control spools 42 in all of the valve sections are in the neutral (i.e. centered) position. In that situation the metering orifice of valve section 14 is closed so that the supply passage 31 does not communicate with feeder passage 43. The position of the control spool also connects the bridge passage 50 to the tank 19. Therefore, the poppet 60 is forced against bore end wall 61 by spring 76. When the valve elements 64 in all the valve sections are closed, the fluid within the load sense transfer passage 34 bleeds through the relief orifice 37 in the end plate 16, shown in FIG. 1, until the load sense pressure equals the tank pressure.

Figure 5:
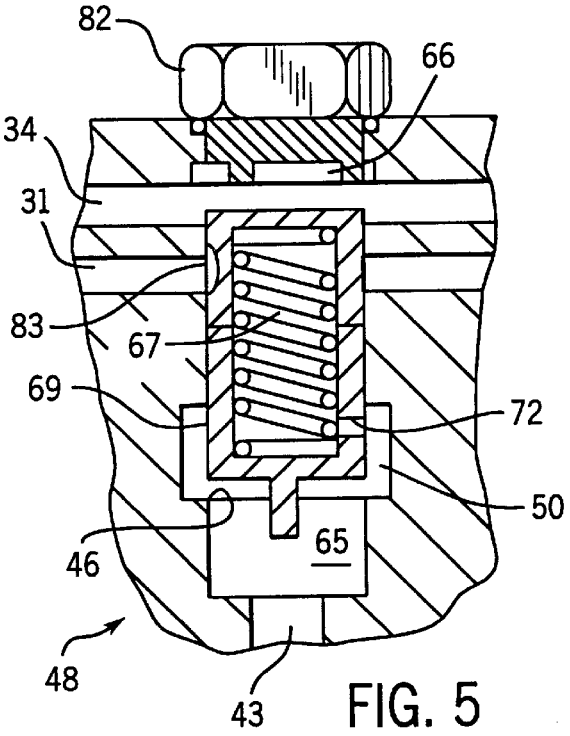
Figure 6:
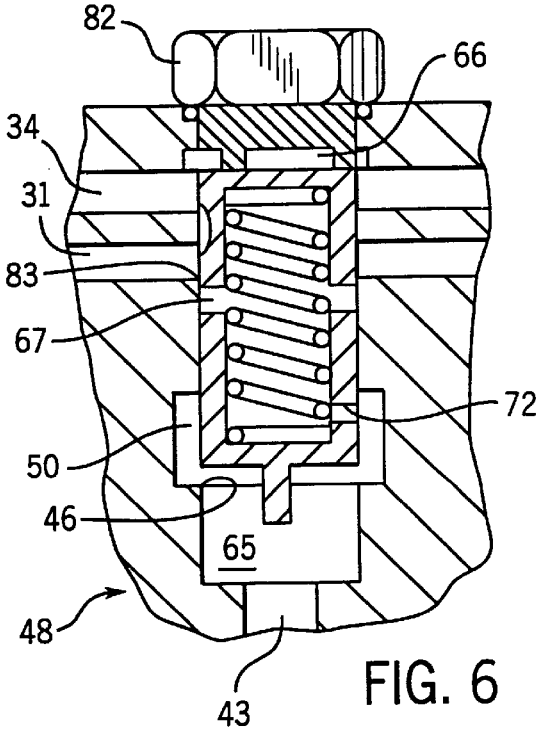

During normal operation, when the user moves the spool 42 to supply hydraulic fluid to one of the workports 54 or 56, pressure in the feeder passage 43 forces the poppet 60 away from bore end wall 61 and creates a flow passage between the feeder passage 43 and the bridge 50, as shown in FIGS. 5 and 6. The hydraulic fluid flows through this passage to the selected workport. Because the top of the valve element 64 has substantially the same surface area as the bottom of poppet 60, fluid flow is throttled at the variable orifice 46 so that the pressure in the first chamber 65 of compensation valve 48 is approximately equal to the greatest workport pressure in the second chamber 66. This pressure is the communicated to one side of metering orifice 44 via feeder passage 43 in FIG. 2. The other side of metering orifice 44 is in communication with supply passage 31, which receives the pump output pressure that is equal to the greatest workport pressure plus the constant margin pressure. As a result, the pressure drop across the metering orifice 44 is equal to the margin pressure. Changes in the greatest workport pressure are seen both at the supply side (passage 31) of metering orifice 44 and in the first chamber 65 of pressure compensating check valve 48. In reaction to such changes, the poppet 60 and valve element 64 find balanced positions in bore 62 which maintain the margin pressure across metering orifice 44.

The poppet 60 acts as a check valve which prevents the hydraulic fluid from being forced backwards through the valve section 14 from the actuator 20 to the pump 18 when workport pressure is greater than the supply pressure in feeder passage 43. This effect, commonly referred to as "craning" with respect to off-highway equipment, happens when a heavy load is applied to the associated actuator 20. When this occurs, the excessive load pressure appears in the bridge 50 and is communicated through the transverse aperture 72 in the poppet 60 to the intermediate cavity 67 between the poppet and the valve element 64. Because the resultant pressure in intermediate chamber 67 is greater than pressure in the feeder passage 43, the poppet 60 is forced against bore end wall 61, as seen in FIGS. 1, 3 and 4, thereby closing communication between the feeder passage 43 and the bridge 50 at the bore outlet port 69. The craning condition can be terminated by reversing the process that created it, e.g. removing the excessive load on the actuator.

The valve element 64 is part of a mechanism which senses the pressure at every powered workport of the valve sections 13–15 in the multiple valve assembly 12, and in response varies the pressure applied to the displacement control port 32 of the hydraulic pump 18. As seen in FIGS. 3 and 6, the pressure in the bridge 50 is applied through the transverse aperture 72 of the poppet 60 to the intermediate chamber 67 between the poppet and the valve element 64 and thereby to one side of the valve element 64. Bridge 50 and thus the intermediate chamber see the pressure at whichever workport 54 or 56 of the respective valve section is powered, or the pressure of reservoir passage 36 when the control spool 42 is in neutral. The pressure in the load sense transfer passage 34 is applied to the other side of the valve element 64. When the bridge pressure is greater than pressure in the load sense transfer passage 34 (i.e. valve section 14 has the greatest workport pressure), the valve element 64 is urged toward the plug 82 so that the notch 80 communicates with both the load sense transfer passage and the pump supply passage 31. In this position, the pump output pressure, as regulated by a variable orifice provided by the notch 80, is transmitted to the control input 32 of the hydraulic pump 18 via the load sense transfer passage 34.

When the workport pressure in valve section 14 falls below the load sense pressure, the valve element 64 is urged away from the plug 82 as depicted in FIGS. 4 and 5. This may occur when another valve section has a greater workport pressure. Such movement of the valve element 64 closes communication between the load sense transfer passage 34 and the pump supply passage 31 at the bore inlet port previously provided through the notch 80.

Figure 7:
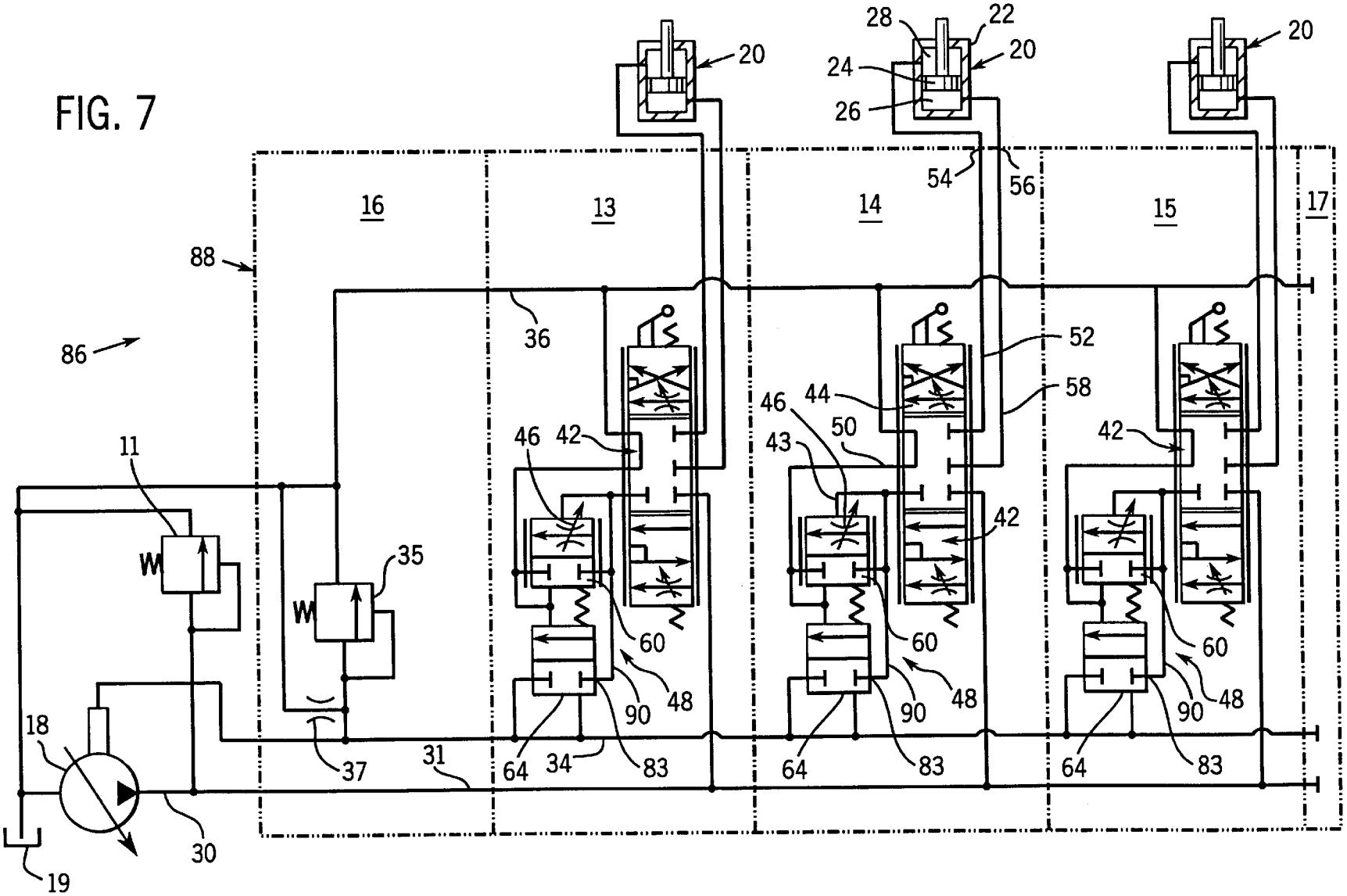
FIG. 7 illustrates a second embodiment of a multiple valve assembly according to the present invention.

FIG. 7 illustrates a hydraulic system 86 with a second version of a multiple valve assembly 88 according to the present invention. Like reference numerals have been given similar components to those in the first embodiment of FIGS. 1–6. The only difference with respect to the second multiple valve assembly 88 is that the inlet port 83 of the bore for the pressure compensating valve 48 is connected by passage 90 to the feeder passage 43, instead of directly to the pump supply passage 31. The valve element 64 operates in essentially the same manner as described previously in controlling the application of pressure from the pump output to the control input of the pump 18. That application is responsive to the workport pressures in each of the valve sections 13–15 and provides similar control of the pump pressure.

I claim:

1. In a hydraulic system having an array of valve sections for controlling flow of hydraulic fluid from a pump to a plurality of actuators, the pump produces an output pressure that is a function of pressure at a control input, and each valve section having a workport to which one actuator connects and having a spool with a metering orifice that is variable to regulate flow of the hydraulic fluid from the pump to the one actuator; the improvement comprising:

each valve section having a poppet and a valve member slidably located in a bore thereby defining a first chamber on one side of the poppet, a second chamber on one side of the valve member and an intermediate chamber between the poppet and the valve member, the poppet and valve member biased apart by a spring, the first chamber connected to the metering orifice and the second chamber connected to the control input of the pump, the intermediate chamber communicating with an output port of the bore through which hydraulic fluid flows to the actuator, and the bore having an inlet port adjacent the valve element and separated from the second chamber and receiving a pressure which is dependent upon the output pressure of the pump wherein the bore and the valve member form a variable passage between the inlet port and the second chamber; and wherein movement of the poppet within the bore varies flow of hydraulic fluid through the bore between the first chamber and the outlet port, and a movement of the valve member with in the bore, varies transmission of the output pressure through the bore from the inlet port to the second chamber.

2. The hydraulic system as recited in claim 1 further comprising a bleed orifice connecting the control input of the pump to a fluid reservoir for the pump.

3. The hydraulic system as recited in claim 1 wherein the poppet and valve member are unbiased with respect to the bore.

4. The hydraulic system as recited in claim 1 wherein:

the poppet has a tubular section with an open end and a closed end; and the valve member has a tubular portion with a closed end and an open end, wherein the tubular portion faces the tubular section.

5. The hydraulic system as recited in claim 4 wherein the poppet has stop shaft extending outward from the closed end of the tubular section into the first chamber.

6. The hydraulic system as recited in claim 4 wherein the tubular section of the poppet has a transverse aperture which provides continuous communication between the outlet port and the intermediate cavity regardless of movement of the poppet within the bore.

7. The hydraulic system as recited in claim 1 wherein the pressure which is dependent upon the output pressure of the pump is produced by operation of the metering orifice.

8. A hydraulic valve mechanism for enabling an operator to control the flow of pressurized fluid in a path from a variable displacement hydraulic pump to an actuator which is subjected to a load force that creates a load pressure in a portion of the path, the pump having a control input and producing an output pressure which varies in response to pressure at the control input; the hydraulic valve mechanism comprising:

a first valve element and a second valve element juxtaposed to provide between them a metering orifice in the path, at least one of the valve elements being movable under control of an operator to vary a size of the metering orifice and thereby control flow of fluid to the actuator; and a pressure compensator for maintaining a substantially constant pressure drop across the metering orifice, the pressure compensator having a poppet and a valve member slidably located in a bore thereby defining first and second chambers at opposite ends of the bore, the poppet and valve member being biased apart by a spring in an intermediate cavity, the first chamber being in communication with the metering orifice and the second chamber connected to the control input of the pump, and the bore having an inlet which receives the output pressure from the pump and having an outlet through which fluid flows to the actuator;

wherein a first pressure differential between the first and intermediate chambers and a force exerted by the spring determines a position of the poppet with in the bore, the position of the poppet defining a size of a variable orifice through which hydraulic fluid is supplied from the first chamber to the outlet, whereby a greater pressure in the first chamber than in the intermediate chamber enlarges the size of the variable orifice and a greater pressure in the intermediate chamber than in the first chamber reduces the size of the variable orifice; and wherein a second pressure differential between the second and intermediate chambers and a force exerted by the spring determines a position of the valve member with in the bore, the position of the valve member controlling transmission of pressure between the inlet and the second chamber, whereby a greater pressure in the second chamber than in the intermediate chamber urges the valve member to reduce transmission of pressure between the inlet and the second chamber, and a greater pressure in the intermediate chamber than in the first chamber urges the valve member to increase transmission of pressure between the inlet and the second chamber.

9. The hydraulic system as recited in claim 8 further comprising a bleed orifice connecting the control input of the pump to a fluid reservoir for the pump.

10. The hydraulic valve mechanism as recited in claim 8 wherein the poppet and valve member are unbiased with respect to the opposite ends of the bore.

11. The hydraulic valve mechanism as recited in claim 8 wherein the inlet of the bore receives the output pressure from the pump as affected by the metering orifice.

12. The hydraulic valve mechanism as recited in claim 8 wherein:

the poppet has a tubular section with an open end and a closed; and the valve member has a tubular portion with a closed end and an open end slidably received within the tubular section of the poppet, wherein the tubular portion and the tubular section define the intermediate cavity.

13. The hydraulic valve mechanism as recited in claim 12 wherein the poppet has stop shaft extending outward from the closed end of the tubular section.

14. The hydraulic valve mechanism as recited in claim 12 wherein the tubular section of the poppet has a transverse aperture which provides continuous communication between the first passage and the intermediate cavity regardless of the position of the poppet within the bore.

* * * * *